US005259308A

United States Patent [19]

Wirz

[11] Patent Number: 5,259,308

[45] Date of Patent: Nov. 9, 1993

[54] SHEET-FED ROTARY OFFSET PRINTING MACHINE

[75] Inventor: Arno Wirz, Bammental, Fed. Rep. of Germany

[73] Assignee: Heidelberger Druckmaschinen AG, Heidelberg, Fed. Rep. of Germany

[21] Appl. No.: 785,033

[22] Filed: Oct. 30, 1991

[30] Foreign Application Priority Data

Nov. 14, 1990 [DE] Fed. Rep. of Germany ..... 4036253

[51] Int. Cl.[5] ..... B41F 5/02

[52] U.S. Cl. ..... 101/230; 271/186; 271/291

[58] Field of Search ..... 101/222, 230; 271/186, 271/291

[56] References Cited

U.S. PATENT DOCUMENTS

| | | | |
|---|---|---|---|
| 3,772,990 | 11/1973 | Weisgerber | 101/230 |
| 3,796,154 | 3/1974 | Weisgerber | 101/230 |
| 3,884,146 | 5/1975 | Ruetschle | 101/230 |
| 4,014,261 | 3/1977 | Becker | 101/230 |
| 4,024,814 | 5/1977 | Becker | 101/230 |
| 4,099,463 | 7/1978 | Zimmermann et al. | 101/230 |
| 4,122,773 | 10/1978 | Wirz | 101/230 |
| 4,147,105 | 4/1979 | Becker | 101/230 |
| 4,241,659 | 12/1980 | Fischer | 101/230 |
| 4,535,691 | 8/1985 | Kida | 101/230 |
| 4,856,426 | 8/1989 | Wirz . | |
| 4,930,414 | 6/1990 | Wirz . | |

FOREIGN PATENT DOCUMENTS

| | | | |
|---|---|---|---|
| 380832 | 7/1986 | Austria . | |
| 0161522 | 11/1985 | European Pat. Off. | 101/230 |
| 0046977 | 4/1980 | Japan | 101/230 |
| 2165801 | 4/1986 | United Kingdom . | |

OTHER PUBLICATIONS

P. 2 of 216-801 not provided.

*Primary Examiner*—Eugene H. Eickholt

*Attorney, Agent, or Firm*—Herbert L. Lerner; Laurence A. Greenberg

[57] ABSTRACT

A sheet-fed rotary printing machine having printing units for processing sheets with single-side multicolor or first form and perfector printing, a feeder for feeding the sheets to the printing units, and a preceding sheet processing unit located upstream of the printing units as viewed in sheet-feeding direction in the printing machine, also has a work and tumble device including a sheet turning device disposed in the sheet-feeding direction between the preceding sheet processing unit and the printing units for the first form and perfector printing.

8 Claims, 2 Drawing Sheets

SHEET-FED ROTARY OFFSET PRINTING MACHINE

The invention relates to a sheet-fed rotary offset printing machine having printing units for processing sheets with single-side multicolor or first-form and perfector printing, a feeder for feeding the sheets to the printing units, and a preceding sheet processing unit such as a printing or finishing unit located upstream of the printing units as viewed in sheet-feeding direction in the printing machine; in particular, the invention relates to such a printing machine wherein a number of ink printing units which print the sheet from above are arranged in tandem one after the other in the sheet-feeding direction.

Sheet-fed rotary offset printing machines of the foregoing general type having a number of in-tandem printing units for single-side multi-color printing as well as for first form and perfector printing have become known heretofore from U.S. Pat. Nos. 4,856,426 and 4,930,414.

The machine described in U.S. Pat. No. 4,856,426 is provided with a turning device located between two printing units, wherein transfer cylinders taking a sheet coming from a preceding printing unit and conveying the sheet to a succeeding turning cylinder having tongs grippers, which are arranged in a cylinder gap recess, grip the trailing edge of the sheet initially passing a location at which the distance between the two cylinders is the smallest and convey the sheet, with the trailing edge thereof first, to the next following printing unit, thereby turning the sheet.

U.S. Pat. No. 4,930,414 discloses a different type of turning device provided between printing units of a sheet-fed rotary offset printing machine for multi-color printing. In this case, a sheet transfer cylinder receiving a sheet from a preceding printing unit is followed by a sheet support having an upper support surface which is substantially flat and approximately tangential to the circumference of the sheet transfer cylinder. The sheet transfer cylinder, during the approach of the grippers thereof which hold the trailing sheet edge, pushes the sheet, with the free leading sheet edge thereof extending forwardly, onto the upper support surface from which the sheet transfer cylinder lifts the sheet, with the trailing sheet edge thereof extending forwardly, thereby turning the sheet. The sheet support may be constructed so as to be fixed or to be a revolving belt. Initially performing perfector printing on the back of a sheet and then first form printing on the front side thereof by such printing machines is a practiced state of the art.

It has furthermore, been known heretofore to provide a printing unit for printing on the back of a sheet, followed by printing units of a sheet-fed rotary offset printing machine for multi-color printing. Such printing units are stationary and are located at the underside of the sheet so that they act from beneath on the sheet being thereafter conveyed to the first printing unit.

Additional printing units which are located underneath the feed table and which act from beneath are difficult to operate and produce an inferior print quality.

If sheets, such as previously processed sheets, especially, lie upside-down in the sheet pile and are thereby raised at the leading and trailing edges thereof, it is necessary to turn the sheet pile over in a separate pile turning device in order to ensure reliable paper travel in the feeder.

Japanese Patent (JP-Sho) 59-192336 discloses a sheet-fed rotary offset printing machine in which printing units of a multi-color printing machine are preceded by a turning device so that, if necessary, a sheet to be printed can be turned over before entering the first printing unit.

It is accordingly an object of the invention to provide a variably usable sheet-fed rotary offset printing machine having printing units which are of in-tandem construction for smear-free multi-color first form printing and perfecting of cardboard and paper, producing a high offset print quality and ensuring reliable processing of the sheets in the feeder.

With the foregoing and other objects in view, there is provided, in accordance with the invention, a sheet-fed rotary printing machine having printing units for processing sheets with single-side multicolor or first form and perfector printing, a feeder for feeding the sheets to the printing units, and a preceding sheet processing unit located upstream of the printing units as viewed in sheet-feeding direction in the printing machine, comprising a work and tumble device including a sheet turning device disposed in the sheet-feeding direction between the preceding sheet processing unit and the printing units for the first form and perfector printing.

In accordance with an another feature of the invention, the sheet-fed rotary printing machine has at least five of the printing units, and the preceding sheet processing unit is a first one of the five printing units.

In accordance with a further feature of the invention, the sheet turning device comprises at least one turning cylinder.

In accordance with an added feature of the invention, the work and tumble device comprises a sheet transfer cylinder and a turning cylinder.

In accordance with an additional feature of the invention, the sheet processing unit preceding the printing units comprises a numbering device.

In accordance with still another feature of the invention, the sheet processing unit preceding the printing units comprises an embossing device.

In accordance with still a further feature of the invention, the sheet processing unit preceding the printing units comprises a cleaning device.

In accordance with a concomitant feature of the invention, the sheet processing unit preceding the printing units comprises a finishing device.

Thus, printing cardboard and paper sheets on the front and rear sides thereof with high offset print quality can be very readily and variably effected in accordance with the respective requirements, e.g., in the case of a printing machine having four or more printing units, one or two printing units thereof are used for printing on the front side and four or three printing units, respectively, for printing on the rear side of the sheet. Even curved or bent cardboard sheets or the like can be processed reliably in the feeder because they may lie with their upper side facing upwardly in the pile of the feeder and can be turned over by means of the additional work and tumble or sheet reversing device before the underside thereof is perfected. With a smooth and flat pile formation, the sheets fed via the feeder may pass the work and tumble or reversing device, which is switched off during first form printing, and may be processed in the heretofore known customary manner.

It is advantageous to use the work and tumble or sheet reversing device when printing cardboard sheet having surfaces which have to be cleaned or subjected to some other finishing treatment such as, e.g., numbering, embossing or the like, before printing. For this purpose, the sheet being fed by the feeder with its upper side facing upwardly is subjected initially to such a finishing treatment, is then turned over by the work and tumble device on the turning device thereof and is perfector-printed on the underside thereof and, after the sheet has been turned over again, is subjected to first form printing on the pre-treated upper side thereof.

When applying an underlay ink for first-form printing, it is especially advantageous to use a work and tumble device in the form of a additional turning device. The work and tumble device permits the underlay ink to be applied from above, then, for perfector printing, the sheet is turned over, so that, after the sheet has been turned another time, first form printing can be performed thereon.

With an imprinting or finishing unit arranged above sheets of thicker paper or cardboard, they can be processed without any problem before passing the additional work and tumble or sheet reversing device so that the sheets than enter the printing units with the upper sides thereof facing upwardly. Such an arrangement is thereby especially favorable with respect to ergonomics and, furthermore, offers an advantageous solution with respect to technical safety requirements.

Other features which are considered as characteristic for the invention are set forth in the appended claims.

Although the invention is illustrated and described herein as embodied in sheet-fed rotary offset printing machine, it is nevertheless not intended to be limited to the details shown, since various modifications and structural changes may be mad therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

Figure 1A:
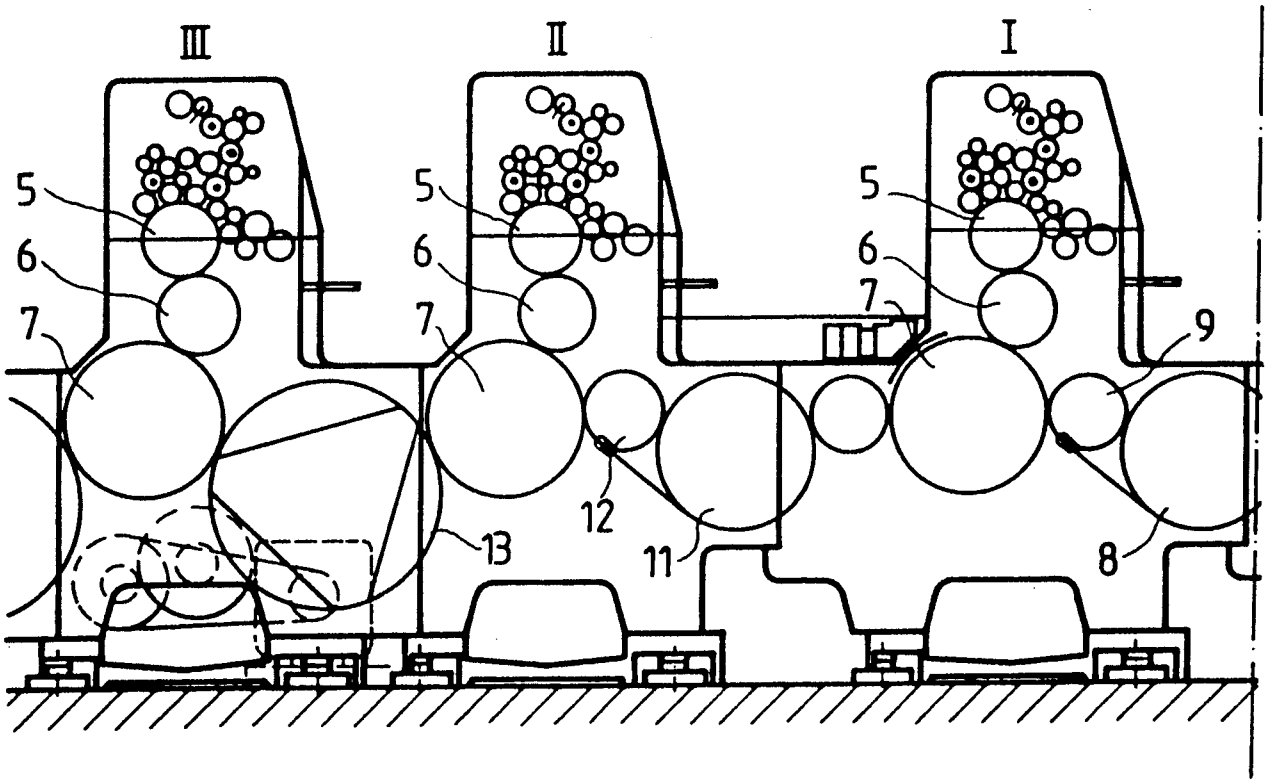
FIGS. 1*a* and 1*b*, taken together, constitute a diagrammatic side elevational view of a sheet-fed rotary offset printing machine incorporating the work and tumble or sheet reversing device provided with an additional turning device.
Figure 1B:
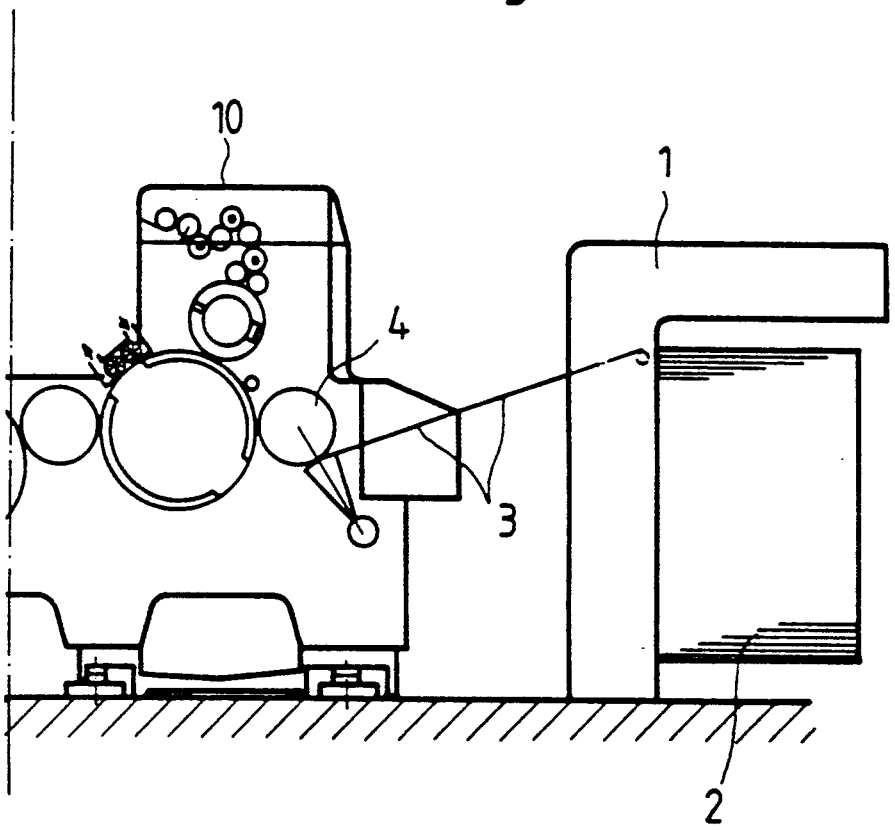

Referring now to the figures of the drawing, there are shown therein ink printing units I, II, III . . . with in-tandem construction. In a feeder 1, sheets to be printed are lifted from a sheet pile 2 and fed to the printing machine, via a pile board 3, by means of a pre-gripping device, such as, a feed cylinder 4 or the like. Each ink printing unit I, II, III . . . includes a plate cylinder 5, a blanket cylinder 6 and an impression cylinder 7.

A sheet processing device such as a printing or finishing unit 10 is followed by a first ink printing unit I, a work and tumble or sheet reversing device in the form of an additional turning device being provided between the printing or finishing unit 10 and the first ink printing unit I. The work and tumble or reversing device includes a transfer cylinder or storage drum 8 and an additional turning cylinder 9. The transfer cylinder 8 has a diameter which is considerably greater than that of the turning cylinder 9, so that the transfer cylinder 8 can take up or receive several sheets simultaneously. After the sheet has been turned over by the work and tumble or reversing device 8, 9, it is transferred to the impression cylinder 7 of the first printing unit I wherein it alternatively undergoes single-side printing or first form printing and perfecting, depending upon which side of the sheet faces upwardly when the sheet is being fed by the feeder. Another turning device formed of a transfer cylinder 11 and a turning cylinder 12 is provided between the printing unit I and the printing unit II. Located between the printing unit II and the printing unit III is a transfer cylinder 13 which receives the sheets to be printed from the impression cylinder 7 of the printing unit II and transfers them to the impression cylinder 7 of the printing unit III.

The foregoing is a description corresponding in substance to German Application P 40 36 253.1, dated Nov. 11, 1990, the International priority of which is being claimed for the instant application, and which is hereby made part of this application. Any material discrepancies between the foregoing specification and the aforementioned corresponding German application are to be resolved in favor of the latter.

I claim:

1. Sheet-fed rotary printing machine having printing units for processing sheets with single-side multicolor or first form and perfector printing, a feeder for feeding the sheets to the printing units, and a preceding sheet processing unit located upstream of the printing units as viewed in sheet-feeding direction in the printing machine for processing sheets which have upturned leading and trailing edges when leaving the sheet processing unit, comprising a work and tumble device including a sheet turning device disposed in the sheet-feeding direction between the preceding sheet processing unit and the printing units for the first form and perfector printing for turning the processed sheets over so that the leading and trailing edges thereof are downturned.

2. Sheet-fed rotary printing machine according to claim 1, having at least five of the printing units, and wherein the preceding sheet processing unit is a first one of the five printing units.

3. Sheet-fed rotary printing machine according to claim 1, wherein the sheet turning device comprises at least one turning cylinder.

4. Sheet-fed rotary printing machine according to claim 1, wherein said work and tumble device comprises a sheet transfer cylinder and a turning cylinder.

5. Sheet-fed rotary printing machine according to claim 1, wherein the sheet processing unit preceding the printing units comprises a numbering device.

6. Sheet-fed rotary printing machine according to claim 1, wherein the sheet processing unit preceding the printing units comprises an embossing device.

7. Sheet-fed rotary printing machine according to claim 1, wherein the sheet processing unit preceding the printing units comprises a cleaning device.

8. Sheet-fed rotary printing machine according to claim 1, wherein the sheet processing unit preceding the printing units comprises a finishing device.

* * * * *